United States Patent [19]

Dimond et al.

[11] Patent Number: 4,515,669

[45] Date of Patent: May 7, 1985

[54] ANODE AND CONNECTION

[75] Inventors: James R. Dimond, Burton; James B. Bushman, Medina, both of Ohio

[73] Assignee: Harco Corporation, Medina, Ohio

[21] Appl. No.: 526,459

[22] Filed: Oct. 6, 1983

Related U.S. Application Data

[63] Continuation of Ser. No. 302,855, Sep. 16, 1981, abandoned.

[51] Int. Cl.[3] ..... C23F 13/00

[52] U.S. Cl. ..... 204/196; 174/84 C; 174/84 R; 204/147; 204/291; 204/292; 204/294; 339/47 R; 339/49 R; 339/268 S; 339/273 R; 411/75; 411/77

[58] Field of Search ..... 204/147, 196, 148, 197; 174/84 S, 84 C, 84 R; 339/47 R–49 B, 268 S, 273 R; 411/75–80

[56] References Cited

U.S. PATENT DOCUMENTS

| | | | |
|---|---|---|---|
| 1,110,797 | 9/1914 | Knox | 411/76 |
| 1,641,627 | 9/1927 | Ericson | 339/273 R |
| 2,838,739 | 6/1958 | Winkler | 339/47 R |
| 3,010,183 | 11/1961 | Forney | 29/863 |
| 3,117,483 | 1/1964 | Brown | 411/76 |
| 3,163,904 | 1/1965 | Ziolkowski | 174/84 S |
| 3,326,791 | 6/1967 | Heuze | 204/196 |
| 3,528,691 | 9/1970 | Matich | 411/80 |
| 4,265,725 | 5/1981 | Tatum | 204/196 |
| 4,268,371 | 5/1981 | Brun et al. | 204/196 |
| 4,279,729 | 7/1981 | Bushman | 204/196 |

*Primary Examiner*—T. Tung

*Attorney, Agent, or Firm*—Maky, Renner, Otto & Boisselle

[57] ABSTRACT

A tubular anode such as tubular cast iron, magnetite, graphite, carbon or steel may be provided with an easily made internal or center connection having assured uniform resistance characteristics by the employment of at least two diametrically opposed wedge blocks, such blocks having parallel crowned and serrated contact surfaces and a wedge surface interface, such interface including a tongue and slot connection between the blocks, one or both blocks having oppositely extending tubular crimpable lead connections. The blocks may be made of malleable material so that when assembled and placed in the proper location inside the anode, one may be held while the other is driven axially, or both may be driven in axially opposite directions easily to form an electrical connection of assured electrical resistivity.

38 Claims, 11 Drawing Figures

ANODE AND CONNECTION

This is a continuation of application Ser. No. 302,855, filed Sept. 16, 1981, and now abandoned.

This invention relates generally to an anode and the electrical connection to the anode as well as to a method for forming such connection.

BACKGROUND OF THE INVENTION

Tubular anodes are widely used in cathodic protection and may be formed of a variety of material such as high silicon cast iron, graphite, carbon, magnetite, steel etc. When formed of metal such as the noted cast iron, the tubular anodes are normally centrifugally cast.

Internal electrical connections for such anodes may include a wire lead extending from one end or both ends. Such anodes are often times connected together in a string or series and electrically interconnected requiring a double-ended connection.

In practice, although there is usually not supposed to be any tension or pull on the wire lead, such tension is sometimes unavoidable in the construction, shipping or installation of the anode. It is thus important that tension on the wire lead from either end of the anode not exert a force which would tend to loosen or disconnect the lead from the anode.

Wedge connections have been widely employed for tubular anodes and such connections usually take the form of a lead plate or other center cone which is driven into and forms a lead or other soft metal ring or collet surrounding the center plate. The center plate may be in the form of a cone or a star-shaped plate to which the wire lead is cast and the plate is then driven into the outer ring which may deform both the center plate and the ring.

One principle problem with such connections is that lead oxide may form on the components and that lead oxide is a complete insulator. Accordingly, it would be an advantage not to use lead which is now commonly employed.

Lead also acts as a heat sink when heated or if soldering, welding or brazing or hot sealant is employed, and this contributes to the formation of the oxide. Moreover, it has to be cooled before installation of the anode.

Also such connections are extremely difficult to form with any consistent desired low level of resistance. If such connections fail to pass a resistivity test, sometimes the entire assembly must be scrapped including the expensive anodes. Also, while a pull on a wire lead in one direction may tend to tighten the wedge connection, a pull on a wire lead extending in the opposite direction would tend to pull the wedge apart. Moreover, such double-ended connections are extremely difficult to form.

Also complicating the formation of prior art lead wedge connections is the requirement for complex assembly tools and a heating of the materials employed to attach a lead wire to the connector as by welding, casting or brazing.

Such leaded connections are, moreover, impractical if the connection has to be made in the field. The heat and special tools make the job very laborious and the connection unreliable. Also, lead tends to be bent out of shape and can't be reused.

It should also be noted that if the connection completely blocks the interior of the anode as many wedge ring types do, it is then more difficult to seal the connection inside the anode. The sealing material would then have to be poured into the anode from opposite ends and this is a time consuming and cumbersome task, particularly with long anodes.

It is therefore important to provide an electrical connection for such anodes which can quickly and easily be made and which will provide an assured consistency of low resistivity. It is also important that the connection be inexpensive and readily used with either single or double end connections, with a pull on the wire lead from either direction simply further tightening the connection.

SUMMARY OF THE INVENTION

The present invention provides a tubular anode such as tubular cast iron, magnetitie, graphite, carbon or steel, with an easily constructed and low cost internal or center connection having assured uniform low resistance characteristics. The connection is formed by a pair of coplanar diametrically extending contact members or blocks with a wedge surface therebetween so that axial movement of one or axial opposite movement of both diametrically expands the contact members into locked electrical contact with the interior of the anode. The blocks are generally symmetrical and have tongue and slot connection at the wedge interface to maintain the coplanar diametrical alignment. The outer or parallel anode contacting surfaces may be provided with serrated teeth or ridges which on installation remove films or oxides and silicates from the internal surface of the anode tube, and also wiping the anode surface with the conductive alloy of the block. The wiping action will of course also remove any oxide films from the mating surfaces of the connection blocks. Such serrations also assist in locking the anode connection blocks in final position.

Both blocks have tubes extending from their smaller ends to which the lead wires may be connected by crimping the tubes and wire. This avoids the use of heat as in welding, casting or brazing.

The blocks may be readily formed by die casting and may be formed in various sizes, each size accomodating in turn a range of sizes of anodes. The material of the blocks may be formed of conductive alloy material which is malleable to some extent. The semi-rigid material may be a zinc alloy.

The serrated outer surfaces are crowned or arched providing a better mating with the interior curved surfaces of the tubular anode also permitting the wiping teeth to deform and match the anode I.D.

The blocks may be preassembled temporarily and placed inside of the tubular anode. The blocks may be driven in opposite directions by a relatively simple tool, while one block may be held while the other block is driven. Each block is then wedged between the other block and the I.D. of the anode. Because of the open space on each side of the diametrically extending blocks, sealants to enclose the connections may be poured in from only one end.

It is accordingly a principal object of the present invention to provide a tubular anode with an internal electrical connection which includes two generally symmetrical opposed wedge blocks.

Another principle object is the provision of such connection where the two blocks are diametrically opposed to each other and held in such position by a tongue and slot connection at the wedge interface.

Another important object is the provision of such blocks which have serrated parallel block-anode contact surfaces.

A further object is the provision of such surfaces which are serrated to provide a wiping action and to assist in locking the wedge block in place.

Another object is the provision of such connection wherein the blocks are formed of malleable metal such as a zinc alloy.

Also an object is the provision of such connection wherein each block is provided with a tubular crimp sleeve to which a wire connection can readily, quickly and mechanically be made.

A further important object is the provision of such connection wherein tension on the wire even in a double-ended connection will serve simply further to tighten the connection.

It is also an object to provide a low cost method of forming an internal connection for an anode which does not require great skill and which achieves a high degree of consistency in the desired low resistivity or quality of the connection. The connection also readily lends itself to field assembly.

It is an object of the invention to provide such method wherein the opposed wedge blocks are driven in opposite directions or one is held while the opposite one is driven.

In one embodiment the wedges may be driven together and locked in position by a rotational drive driven to a predetermined torque.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE DRAWINGS

Figure 1:
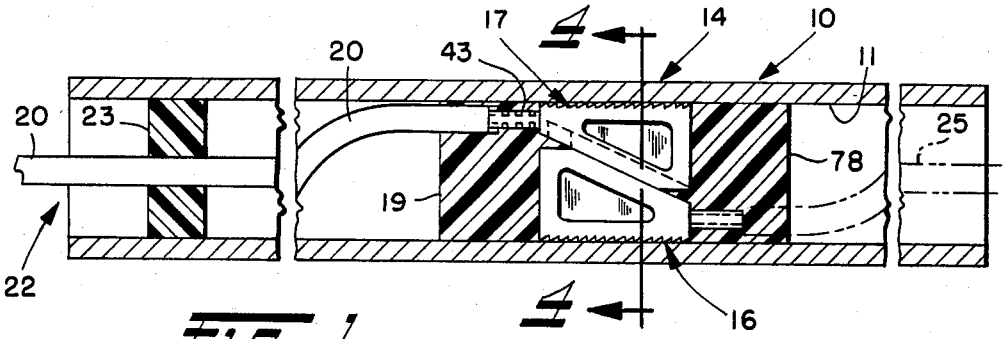
FIG. 1 is a longitudinal fragmentary section broken away of an anode in accordance with the present invention showing the electrical connection in place.

Referring first to FIG. 1, there is illustrated a tubular anode 10 which as indicated may be made from a variety of materials such as high silicon cast iron, steel graphite, magnetite, etc. If made of steel or high silicon cast iron, the anode is usually centrifugally cast in tubular form. In such case the interior surface 11 or I.D. of the anode will have a rough or irregular surface.

An electrical connection to the anode is provided generally at 14. The connection is normally provided in the axial center of the anode because of the well-known "pencil" effect. Anodes tend to discharge a high percentage of their total current from the ends of the anode and thus the ends tend to corrode first. However, when anodes are quite long, it is difficult to form a connection interiorly of the anode at the center.

Figure 3:
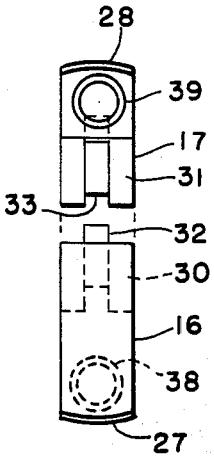
FIG. 3 is an end elevation of the two blocks as seen from the line 3—3 of FIG. 2.
Figure 2:
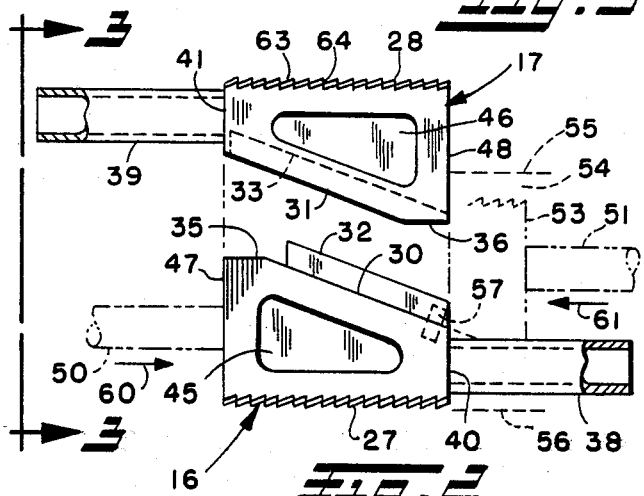
FIG. 2 is an enlarged exploded view of the two wedge blocks used to form the connection and also showing in phantom lines the relative position of the blocks inside the anode before final assembly.

The connection 14 of the present invention is formed by two mating wedge blocks 16 and 17 which are shown in greater detail in FIGS. 2 and 3. The connection may be encapsulated by poured-in-place sealant 19 and the insulated wire lead 20 extends through the sealant and out of the end 22 of the anode through centering disc 23. In the embodiment illustrated in FIG. 1, a wire lead extends outwardly through one end only of the anode but it will be appreciated that a double ended anode may be provided with leads extending from both ends. The other wire lead in a double-ended connection would be as indicated by the phantom lines seen at 25.

Referring now more particularly to FIGS. 2 and 3, it will be seen that each block 16 and 17 may be formed integrally of a malleable zinc alloy by die casting. Such blocks 16 and 17 each include parallel block-anode contacting surfaces which are serrated as seen at 27 and 28, respectively. Such surfaces are also slightly crowned or arched longitudinally of the blocks as seen more clearly in FIG. 3. The blocks are generally triangular in shape and each includes a wedge interface as seen at 30 and 31, respectively. In the illustrated embodiment the wedge angle may be 20° with respect to the axis of the anode. Depending upon the anode material and application, the wedge angle may vary considerably such as from about 5° to about 40° and may be greater than the angle of friction.

Although the blocks are quite similar and generally symmetrical about the wedge interface, it is noted that the block 16 includes a tongue 32 along the wedge interface while the block 17 includes a slot 33.

It is also noted that the wedge interface 30 is chamfered or relieved as indicated at 35, beyond the tongue 32 while the wedge interface 31 is relieved in a similar manner at 36 on each side of the slot, 33. This permits clearance with the tubular extensions projecting at 38 and 39 from the smaller end faces 40 and 41 of the blocks 16 and 17, respectively. To attach the bare end of the lead wire to the blocks, the bare end is simply inserted into the respective tube and the tube is then crimped on the bare lead end as indicated at 43 in FIG. 1.

Each block is provided with a solid center web more narrow than the total width of the block and of the triangular configuration seen at 45 and 46. The web is, of course, of sufficient thickness to resist the compressive forces on the block when in tight wedged engagement in the anode.

The larger end faces of the block seen at 47 and 48, respectively, extend normal to the axis of the anode and may be engaged or tapped by simplified driving tools seen in phantom lines in FIG. 2 at 50 and 51, respectively.

In order to assemble the connection within the anode, the blocks are first preassembled in the relative positions seen by the phantom lines in FIG. 2. Thus, the block 17 will achieve the position seen at 53 with its surface 28 having some clearance indicated at 54 within the I.D. of the tube seen at 55. The surface 27 of the opposite block 16 simply rests on the I.D. of the tube as seen at 56. The blocks may be held together in their preassembled relationship shown by the suitable temporary fastener such as a piece of tape seen at 57, or by a conductive shim in the interface between the tongue and slot.

With the blocks of the connection properly in position within the tube, the driving tools 50 and 51 are employed to drive the blocks in the opposite direction as seen by the arrows 60 and 61. This causes the wedge interface of the two blocks to diametrically separate the blocks closing the clearance 54 and driving the surfaces 27 and 28 first into wiping engagement and then into locking engagement with the I.D. 11 of the tube.

It is noted that the serrations on the surfaces 27 and 28 include acutely angled leading edges 63 and sharply angled trailing edges 64 to achieve the noted initial wiping action without unduly resisting the driving of the clocks into locking engagement. The more sharply defined edges 64 assist in locking the blocks in position when driven to the desired locking pressure. Such wiping action of the ridges of the serrations serve to remove films or oxides and silicates from the internal surfaces of the anode tube, and also to smear the semi-rigid material of the block such as a zinc alloy along the inside surface of the anode. Such semi-rigid material also readily conforms to any irregularities normally found in the internal surface of centrifugally cast anodes. It will be appreciated that the wedge blocks are normally assembled as seen in FIG. 2 with the lead wire connections already made. It will also be appreciated that the lead wire connections may be made from both blocks and that any tension or pulling on the wires will simply tend to tighten the connection.

If after the connection is made, for some reason the connection has to be disassembled such as for failure to pass a quality control test, the blocks can easily be removed by using the tools 50 and 51 to drive the blocks in the opposite direction engaging the more narrow end faces thereof. The blocks and anodes may be reused. Such techniques can be used to avoid scrap anodes which are very costly and to assure quality control. It will also be appreciated that the blocks may even be removed after the sealants are in place. Depending on the particular sealant employed, it may be drilled out or removed and then the blocks removed.

It will be appreciated that the serrations on the surfaces 27 and 28 which wipe in one direction and lock in the opposite direction may vary as to the number of teeth and coarseness thereof. The configuration of the serration normally depends on the material of the anode. For example, in a graphite anode, there may be two to three times as many teeth providing a much finer texture.

Figure 6:
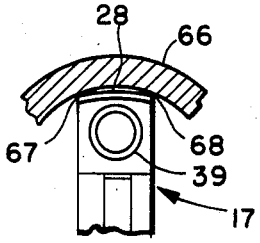
FIG. 6 is a fragementary end elevation of a block within the tubular anode showing the wiping contact.
Figure 7:
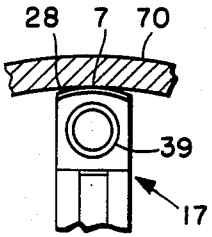
FIG. 7 is a similar view of a larger anode showing the wiping contact.

The crowned serrated outer surfaces permit ensured good wiping and locking contact with the interior of the anode and tend to match the circle of the anode regardless of the diameter of the anode. As seen in FIG. 6, for an anode 66 of somewhat smaller diameter the crowned serrated surface 28 engages and wipes primarily along the lateral edges of the surface as seen at 67 and 68. For a larger diameter as seen at 70 in FIG. 7, the wiping and engaging action is primarily at the center of the crown as seen at 71. In either case such action tends to change the radius of the crown to conform to the anode.

It will also be appreciated that the blocks 16 and 17 may be formed in a variety of sizes to accomodate for each size a fairly wide range of anode sizes.

Figure 5:
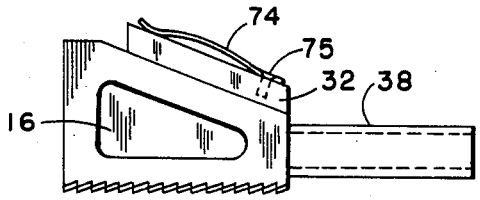
FIG. 5 is an alternative form of block using a yieldable shim or leaf spring to accomodate possible expansion of the anode under high temperature conditions.

In the embodiment seen in FIG. 5, the block 16 is provided along the top of the tongue 32 with a yieldable shim 74 which is in the form of a leaf spring held in place by flush head fastener or rivet 75. The spring compensates for expansion or contraction of the anode I.D. in high temperature operating conditions or in fluctuating temperature operating conditions.

Although the connection is preferably formed at the middle of the anode, it will be appreciated that it can be formed as quickly anywhere along the interior of the anode.

Figure 4:
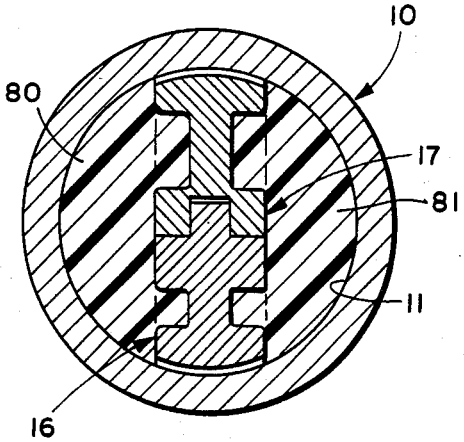
FIG. 4 is an enlarged transverse section through the anode at the connection showing the blocks assembled as seen from the line 4—4 of FIG. 1.

Once the connection is formed with the single or double end connection, the connection may be readily encased or encapsulated in plastic sealants such as epoxies or the like by forming a temporary dam indicated at 78 then pouring sealant 19 in from the open upper end 22. Because of the relatively large semi-circular open spaces on each side of the wedge blocks as seen at 80 and 81 in FIG. 4, the sealant will readily flow past the connection. The wire or lead extends outwardly and then through the centering disc which of course may be provided at both ends in connection with a double ended anode.

Figure 9:
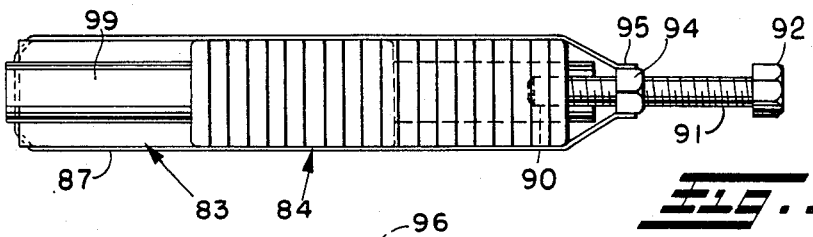
FIG. 9 is a top plan view of the embodiment of FIG. 8 as seen from the line 9—9 thereof.
Figure 8:
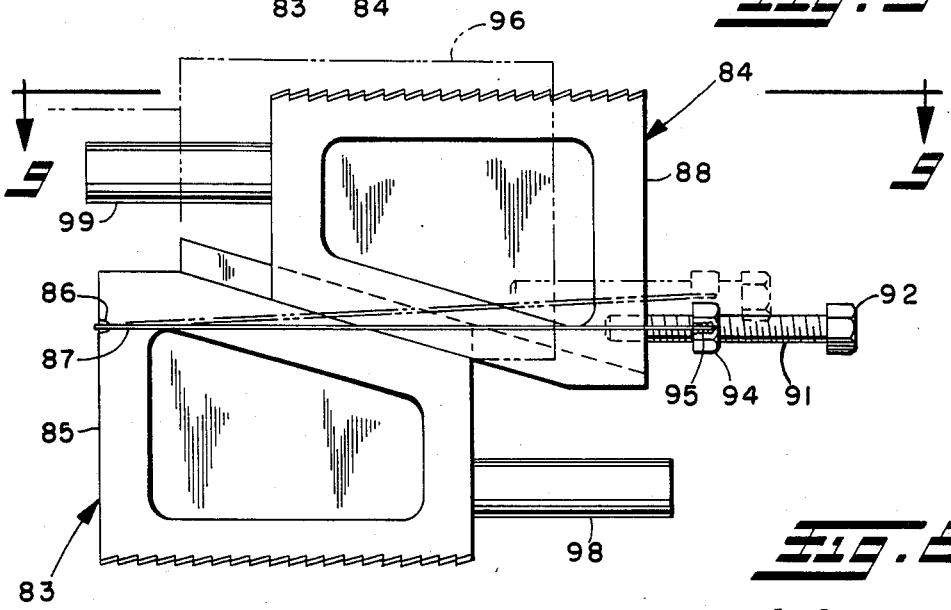
FIG. 8 is a side elevation of another form of the invention using an encircling cinch to drive and lock the wedges together.

Referring now to the embodiment of FIGS. 8 and 9, it will be seen that the wedges may be driven and locked together by the mechanism shown. The wedge blocks 83 and 84 may be substantially the same or similar to the wedge blocks 16 and 17 seen in FIG. 2. The larger end wall 85 of the wedge block 83 is provided with horizontally aligned corner notches 86 which receive a wire cinch or band 87 which encircles both wedge blocks.

The larger end wall 88 of the wedge block 84 is provided with blind untapped hole 90 receiving threaded stud 91 which is provided with a hexagonal head 92. Mounted on the threaded stud is a nut 94 to which the opposite ends of the wire or band cinch 87 are secured as seen at 95. The wedge blocks are then assembled in the position shown by full lines and by then driving the hexagonal head to rotate the threaded stud 91, the nut 94 is drawn away from the end wall 88 forcing the top block 84 to the left and the bottom block 83 to the right as seen in FIG. 8, driving the top block up to the relative position seen in phantom lines at 96. The stud and nut then act as a reaction member between the cinch and the blocks driving the blocks into wedge locking relationship within the interior of the anode. The wedge blocks are provided with the wire lead crimp sleeves or tubes seen at 98 and 99, respectively. The threaded stud 91 may readily be rotated inside the anode by a suitable socket heat extension and the wedges may be tightened to a predetermined torque to provide the desired wedge locking action and the low resistance connection. This construction enables connections readily to be made in tubular anodes where one end may be closed. The cinch or band being inherently elastic acts as a spring lock keeping pressure on the wedge blocks regardless of minor anode I.D. variations due to temperature expansions and contractions.

Figure 10:
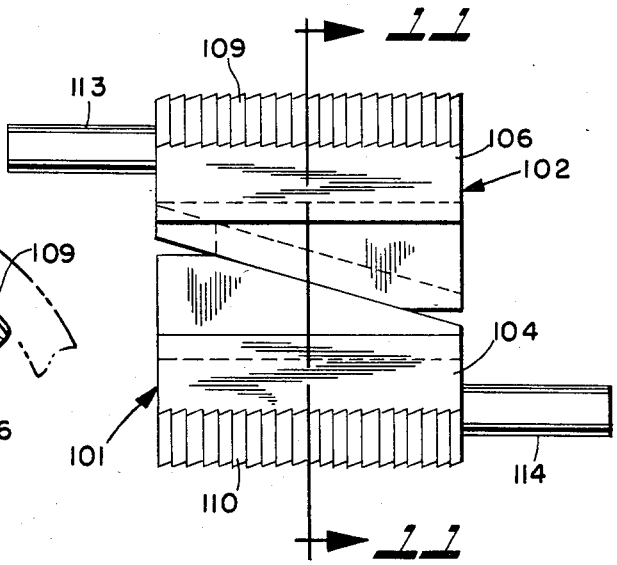
FIG. 10 is a side elevation of another form of wedge.
Figure 11:
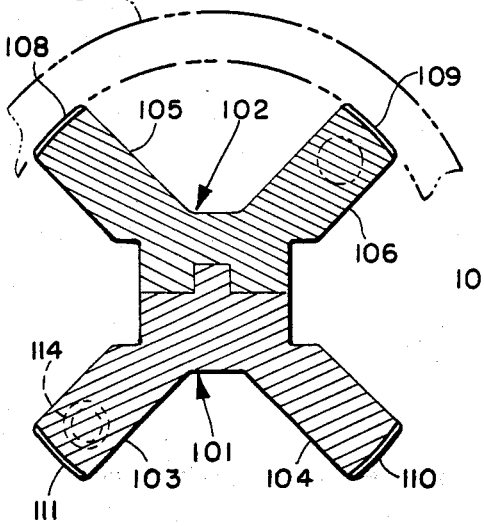
FIG. 11 is a transverse section of the embodiment of FIG. 10 taken on the line 11—11 thereof.

In the embodiment of FIGS. 10 and 11, it will be seen that instead of coplanar blocks, each of the mating blocks 101 and 102 is provided with two angularly related legs at approximately 90° as seen at 103 and 104 for the block 101, and 105 and 106 for the block 102. The connection then provides four contact surfaces inside the tubular anode 107 as seen at 108, 109, 110 and 111. The contact surfaces 108 and 110 are diametrically opposed to each other while the surfaces 109 and 111 are also diametrically opposed. The wire lead crimp tubes 113 and 114 may extend from the legs 106 and 103, respectively, but it will be appreciated that they may be provided on each leg and in different positions. In any event, with the embodiment of FIGS. 10 and 11, it will be seen that each wedge block includes at least two anode contacting surfaces and that the connection is in the form of an X with each contacting surface approximately 90° apart.

For both of the embodiments of FIGS. 8 and 10 it will be appreciated that the wedge interface between the blocks is provided with the tongue and slot connection.

It can now be seen that there is provided a tubular anode with a low cost, easily made, and reliable electrical connection. Moreover, the connection does not require expansion or distortion of the anode. With the connection a single or double-ended connection can readily be made and any tension on the lead wire serves simply to tighten the connection. Moreover, one size of connector components will handle a wide range of sizes of anodes and the wiping teeth or serrations on the curved or crowned connection-anode surfaces tend to deform to match the anode I.D. Also, the connection can simply and quickly be made, even in the field, or removed if need be.

We claim:

1. A tubular cathodic protection anode including a tubular anode member with outside surface means for transmitting a flow of electricity between said anode member and a surrounding medium and an inside surface, an internal electrical connection, said connection comprising at least two opposed wedge blocks, said wedge blocks being adapted relatively to be driven axially to be wedged tightly radially against said inside surface of said tubular anode member, said blocks being of such dimensions that a sealant flow passage open at both axial ends of the wedge blocks to facilitate sealing of the wedge blocks in the anode member is formed interiorly of the anode member along a side of the blocks, and an electrical lead connected to at least one of said blocks.

2. A tubular anode as set forth in claim 1 wherein there are only two such blocks diametrically opposed to each other, each of said blocks including an end face for receiving an axial force and a wedge surface for engaging the corresponding wedge surface of the other of said blocks and for moving said blocks radially away from each other upon the application of axial forces to at least one of said end faces pushing said end faces toward each other.

3. A tubular anode as set forth in claim 2 wherein such diametrically opposed blocks include a wedge surface interface, the opposed blocks at the interface including a tongue in one and a mating slot in the other.

4. An anode as set forth in claim 3 wherein such blocks include parallel outer surfaces adapted to be wedge driven against the inside surface of the anode member, said outer surfaces being radially crowned axially of the block.

5. An anode as set forth in claim 4 wherein said outer surfaces are serrated.

6. An anode as set forth in claim 5 wherein said serrations include a sloping leading edge and a sharp trailing edge.

7. An anode as set forth in claim 3 wherein the angle of the wedge surfaces at the interface with respect to the axis of the anode member is greater than the angle of friction.

8. An anode as set forth in claim 7 wherein such wedge angle is about 20°.

9. An anode as set forth in claim 7 wherein such wedge angle at the wedge surface interface is from about 15° to about 40°.

10. An anode as set forth in claim 3 wherein the angle of the wedge surfaces at the interface with respect to the axis of the anode member is from about 10° to about 30°.

11. An anode as set forth in claim 3 wherein at least one of said blocks at the interface includes a yieldable element.

12. An anode as set forth in claim 1 wherein said blocks are formed of malleable metal.

13. An anode as set forth in claim 12 wherein said blocks are die cast zinc alloy.

14. A tubular anode as set forth in claim 13 wherein said tubular anode member is centrifugally cast iron.

15. An anode as set forth in claim 1 wherein at least one block includes an axially extending tubular extension adapted to receive and be crimped on an electrical lead.

16. An anode as set forth in claim 1 wherein the connection is sealed on opposite axial ends.

17. A method of forming an internal electrical connection to a tubular anode comprising the steps of assembling a pair of opposed wedge blocks, having opposite side surfaces defining a width less than the inside diameter of said anode, inside the anode at substantially the desired location of the connection, then driving the blocks in opposite directions to wedge the blocks against the I.D. of the anode, and then sealing the connection at both axial ends thereof by pouring liquid sealant into the anode from one end only with the sealant flowing past the connection through an open space resulting from the lesser width of the wedge blocks.

18. A method as set forth in claim 17 wherein at least one of said blocks has a wire lead connected thereto before being driven.

19. A method as set forth in claim 18 wherein the wire lead is connected to the block by crimping a tubular extension of the block on such lead.

20. A method as set forth in claim 17 wherein the surface of the blocks engaging the I.D. of the anode is provided with malleable locking teeth providing assured electrical contact with the I.D. of the anode when one or the other or both of the blocks are driven as aforesaid.

21. A method as set forth in claim 17 wherein the step of driving is by rotation.

22. A method as set forth in claim 17 wherein the step of driving is by tightening a cinch around the blocks.

23. A tubular anode including an internal connector therefor comprising opposed wedges generally symmetrical about their wedge interface, said wedges having a side-to-side width dimension less than the inside diameter of the anode providing interiorly of the anode an open space on at least one side thereof to provide a sealant flow passage open at both axial ends of the wedges, and means to drive one or both of said wedges in respective wedging direction to wedge both against the interior of the anode and each other to form a low resistance electrical connection for the anode.

24. An anode as set forth in claim 23 wherein said means to drive comprises an interconnection between said wedges.

25. An anode as set forth in claim 23 wherein said means to drive comprises a cinch adapted to pull said wedges together.

26. An anode as set forth in claim 23 wherein said means to drive is driven axially.

27. An anode as set forth in claim 23 wherein said means to drive is driven rotationally.

28. An anode as set forth in claim 23 wherein said means to drive is driven rotationally to a predetermined torque.

29. An anode as set forth in claim 23 wherein said means comprises a cinch wire encircling said wedge blocks.

30. An anode as set forth in claim 29 including an adjustable reaction member extending between one of said wedge blocks and said cinch wire.

31. An anode as set forth in claim 29 wherein said cinch wire is hinged to one of said blocks.

32. An anode as set forth in claim 29 wherein said cinch wire is hinged to one of said blocks and to an adjustable reaction member connected to the other of said blocks.

33. An anode as set forth in claim 23 wherein the width of the wedges provides substantial open spaces on each side thereof to facilitate sealing the wedges within the anode.

34. An anode as set forth in claim 23 including a tongue and groove interconnection between wedges at the wedge surfaces thereof to maintain said wedges in the proper relation when being engaged with the interior of said anode.

35. An anode as set forth in claim 23 including a sealant filling said open space to encapsulate said wedges.

36. A tubular anode as set forth in claim 23 wherein each wedge block includes at least two anode contacting surfaces.

37. An anode as set forth in claim 36 wherein the contacting surfaces are approximately 90° apart.

38. An anode as set forth in claim 36 wherein the cross-sectional configuration of the opposed wedge blocks is in the form of an X.

* * * * *